US009192938B2

(12) United States Patent
Grover

(10) Patent No.: US 9,192,938 B2
(45) Date of Patent: Nov. 24, 2015

(54) KNIFE ASSEMBLY FOR A WASTE PROCESSING MACHINE AND METHOD OF ASSEMBLY THEREOF

(76) Inventor: Troy S. Grover, Vestaburg, MI (US)

( * ) Notice: Subject to any disclaimer, the term of this patent is extended or adjusted under 35 U.S.C. 154(b) by 0 days.

(21) Appl. No.: 13/348,521

(22) Filed: Jan. 11, 2012

(65) Prior Publication Data

US 2013/0008991 A1 Jan. 10, 2013

Related U.S. Application Data

(60) Provisional application No. 61/431,595, filed on Jan. 11, 2011.

(51) Int. Cl.

| | |
|---|---|
| ***B02C 18/16*** | (2006.01) |
| ***B02C 18/00*** | (2006.01) |
| ***B02C 18/18*** | (2006.01) |
| ***B02C 21/02*** | (2006.01) |

(52) U.S. Cl.

CPC ..... *B02C 18/0084* (2013.01); *B02C 18/18* (2013.01); *B02C 18/184* (2013.01); *B02C 21/02* (2013.01); *B02C 18/00* (2013.01); *Y10T 29/4973* (2015.01)

(58) Field of Classification Search

CPC ..... B02C 18/16; B02C 18/18; B02C 18/145; B02C 18/00; B02C 18/0084; B02C 18/02

USPC ..... 241/293, 294, 191

See application file for complete search history.

(56) References Cited

U.S. PATENT DOCUMENTS

| | | | | |
|---|---|---|---|---|
| 5,060,875 | A | 10/1991 | McBride | |
| 5,129,437 | A | 7/1992 | Nettles et al. | |
| 5,297,746 | A * | 3/1994 | McBride et al. | 241/242 |
| 5,362,004 | A | 11/1994 | Bateman | |
| 5,372,316 | A | 12/1994 | Bateman | |
| 5,413,286 | A | 5/1995 | Bateman | |
| 5,544,826 | A * | 8/1996 | Klingler et al. | 241/242 |
| 5,863,003 | A | 1/1999 | Smith | |
| 5,878,970 | A * | 3/1999 | Leeb | 241/294 |
| 5,988,539 | A | 11/1999 | Morey | |
| 6,000,642 | A | 12/1999 | Morey | |
| 6,016,855 | A | 1/2000 | Morey | |

(Continued)

FOREIGN PATENT DOCUMENTS

| | | |
|---|---|---|
| AU | 4574502 | 12/2002 |
| AU | 200245745 | 12/2002 |

(Continued)

OTHER PUBLICATIONS

U.S. Appl. No. 11/796,074, filed Apr. 26, 2007, Holmes.

(Continued)

*Primary Examiner* — Faye Francis

(74) *Attorney, Agent, or Firm* — Paparella & Associates, PC; Joseph A. Paparella

(57) ABSTRACT

A knife assembly for a waste processing system includes a plurality of cutters disposed on a drum. The cutters further include a cutter body, a knife assembly including a first clamp, a second clamp, and a knife. The knife is removably affixed between the first and second clamp and has at least one cutting surface which extends beyond respective ends of the first and second clamps, whereby the cutter body and knife assembly are operably disposed on a drum for a waste processing system.

1 Claim, 12 Drawing Sheets

(56) References Cited

U.S. PATENT DOCUMENTS

| | | | | |
|---|---|---|---|---|
| 6,032,707 | A | 3/2000 | Morey et al. | |
| 6,036,125 | A | 3/2000 | Morey et al. | |
| 6,047,912 | A | 4/2000 | Smith | |
| 6,059,210 | A | 5/2000 | Smith | |
| 6,076,572 | A | 6/2000 | Cook | |
| 6,293,481 | B1 | 9/2001 | Ragnarsson | |
| 6,299,082 | B1 | 10/2001 | Smith | |
| 6,357,684 | B1 | 3/2002 | Morey | |
| 6,517,020 | B1 | 2/2003 | Smith | |
| 6,591,973 | B2 | 7/2003 | Smith | |
| 6,722,596 | B1 | 4/2004 | Morey | |
| 6,729,567 | B1 | 5/2004 | Morey | |
| 6,804,871 | B1 | 10/2004 | Smith | |
| 6,814,320 | B1 | 11/2004 | Morey et al. | |
| 6,830,204 | B1 | 12/2004 | Morey | |
| 6,845,931 | B1 | 1/2005 | Smith | |
| 6,955,310 | B1 | 10/2005 | Morey | |
| 7,007,874 | B1 | 3/2006 | Smith | |
| 7,011,124 | B1 | 3/2006 | Morey | |
| 7,121,485 | B2 | 10/2006 | Smith | |
| 7,121,488 | B1 | 10/2006 | Marriott et al. | |
| 7,134,622 | B2 * | 11/2006 | Biller et al. | 241/92 |
| 7,163,166 | B1 | 1/2007 | Smith | |
| 7,213,781 | B2 * | 5/2007 | Pakura | 241/294 |
| 7,384,011 | B1 | 6/2008 | Smith | |
| 7,703,713 | B2 * | 4/2010 | Smith | 241/242 |
| 7,726,594 | B2 | 6/2010 | Smith | |
| 8,146,849 | B2 * | 4/2012 | Bacon | 241/294 |
| 8,162,249 | B2 * | 4/2012 | Andersson et al. | 241/294 |
| 8,167,226 | B2 * | 5/2012 | Engnell | 241/294 |
| 8,205,650 | B2 * | 6/2012 | Zinniger et al. | 144/172 |
| 2003/0042346 | A1 * | 3/2003 | Pallmann | 241/294 |
| 2006/0102762 | A1 * | 5/2006 | Garcia et al. | 241/294 |
| 2006/0208120 | A1 * | 9/2006 | McGehee | 241/294 |
| 2011/0062266 | A1 | 3/2011 | Smith | |
| 2012/0018560 | A1 * | 1/2012 | Denis et al. | 241/282.2 |

FOREIGN PATENT DOCUMENTS

| | | |
|---|---|---|
| AU | 763881 | 7/2003 |
| AU | 2009345114 | 4/2011 |
| CA | 2103633 | 3/1994 |
| CA | 2133119 | 4/1995 |
| CA | 2133120 | 4/1995 |
| CA | 2132942 | 3/1996 |
| CA | 2354105 | 3/2002 |
| CA | 2381889 | 12/2002 |
| CA | 2266176 | 12/2010 |
| CA | 2742211 | 4/2011 |
| EP | 1186345 | 3/2002 |
| EP | 1266692 | 12/2002 |
| EP | 1952888 | 8/2008 |
| EP | 09844192.6 | 4/2011 |
| JP | 2002177806 | 6/2002 |
| JP | 2003103193 | 4/2003 |
| WO | WO2010/126541 | 11/2010 |

OTHER PUBLICATIONS

U.S. Appl. No. 10/721,622, filed Nov. 25, 2003, Casper.
U.S. Appl. No. 10/992,158, filed Nov. 18, 2004, Morey.
U.S. Appl. No. 07/942,741, filed Sep. 9, 1992, Bateman.
U.S. Appl. No. 07/874,751, filed Apr. 27, 1992, Bateman.
U.S. Appl. No. 13/318,142, filed Oct. 29, 2011, Morey.

* cited by examiner

KNIFE ASSEMBLY FOR A WASTE PROCESSING MACHINE AND METHOD OF ASSEMBLY THEREOF

CROSS REFERENCE TO RELATED APPLICATIONS

This application claims the benefit of the filing date of U.S. provisional application Ser. No. 61/431,595 entitled "Knife Assembly for a Waste Processing Machine And Method Of Assembly Thereof" which was filed on Jan. 11, 2011 and which is incorporated herein by reference in its entirety.

BACKGROUND OF THE INVENTION

The present invention relates to waste processing machines, and more specifically to waste processing machines including material reducing knife assemblies for processing wood such as brush, branches, and the like, and a method of manufacture thereof.

A variety of machines have been developed to recycle, reduce, or otherwise process wood and brush products. Included therein are machines that chip, cut, grind, or otherwise reduce waste (wood) products including, generally, chippers (disk and drum types), hammer mills, hogs, shredders, grinders, and forestry mowers.

These waste processing systems typically include an infeed system and a waste reducing system, wherein the infeed system is used for directing the waste material to the waste reducing system, the waste reducing system being used for reducing the waste material. Examples of such waste processing machines are disclosed in: U.S. Pat. No. 6,047,912, issued Apr. 11, 2000, entitled "Break-Away Processing Tool For A Waste Processing Machine"; U.S. Pat. Nos. 5,863,003 and 6,299,082; issued Jan. 26, 1999 and Oct. 9, 2001, respectively; all to Smith; and entitled "Waste Processing Machine"; U.S. Pat. No. 6,059,210 issued May 9, 2000 to Smith, entitled "Rotor Assembly For A Waste Processing Machine"; U.S. Pat. No. 6,517,020, issued Feb. 11, 2003 to Smith, entitled "Replaceable Raker Assembly For Processing Tool Of Waste Processing Machine"; U.S. Pat. No. 6,299,082, issued Oct. 9, 2001 to Smith, entitled "Waste Processing Machine"; U.S. Pat. Nos. 6,845,931, 7,121,485, 7,384,011, and 7,726,594; issued Jan. 25, 2005, Oct. 17, 2006, Jun. 10, 2008, and Jun. 1, 2010, respectively; all to Smith; and entitled "Multi-Functional Tool Assembly For Processing Tool of Waste Processing Machine"; and U.S. Pat. No. 7,163,166, issued Jan. 16, 2007 to Smith, entitled "Rotatable Assembly For Machines", all of which are incorporated herein by reference in their entirety.

It is also known to provide a wood chipper for chipping wood such as brush, branches, and the like to produce wood chips. An example of such a wood chipper is disclosed in U.S. Pat. No. 5,988,539, issued Nov. 23, 1999 to Morey, and entitled "Wood Chipper With Infeed Chute Safety Device" which is incorporated herein by reference in its entirety. In these known systems, the wood chipper generally includes an infeed assembly, feed wheel assembly, and a cutting assembly having a rotatable disc or drum with at least one knife or blade for chipping the wood entering the wood chipper and reducing it to wood chips. The chipper also includes a discharge chute for allowing the wood chips to exit the wood chipper, as well as for generally directing them during discharge. Typically, the feed wheel assembly includes: a stationary lower feed wheel, connected to a lower housing; a movable upper feed wheel, connected to an upper housing, and movable relative to the lower housing for allowing wood to enter the cutting assembly. The wood chipper also includes an engine connected to a hydraulic pump, which pumps fluid to drive hydraulic motors to rotate the feed wheels.

Other examples of such wood chippers are disclosed in U.S. Pat. No. 6,032,707, issued Mar. 7, 2000 to Morey et al., entitled "Drum Assembly For A Wood Chipper"; U.S. Pat. No. 6,036,125, issued Mar. 14, 2000 to Morey et al., entitled "Wood Chipper"; U.S. Pat. No. 5,988,539, issued Nov. 23, 1999 to Morey, entitled "Wood Chipper With Infeed Chute Safety Device"; U.S. Pat. No. 6,000,642, issued Dec. 14, 1999 to Morey, entitled "Wood Chipper With Infeed Chute Safety Device"; U.S. Pat. No. 6,722,596, issued Apr. 20, 2004 to Morey, entitled "Multiple Wheel Feed Wheel Assembly For A Wood Chipper"; U.S. Pat. No. 6,357,684, issued Mar. 19, 2002 to Morey, entitled "Adjustable Tension Feed Wheel Assembly For A Wood Chipper"; U.S. Pat. No. 6,830,204, issued Dec. 14, 2004 to Morey, entitled "Reversing Automatic Feed Wheel Assembly For A Wood Chipper"; U.S. Pat. No. 6,814,320, issued Nov. 9, 2004 to Morey et al., entitled "Reversing Automatic Feed Wheel Assembly For Wood Chipper", all of which are incorporated herein by reference in their entirety.

Although these types of waste processing machines have worked well, the existing wood chipping mechanisms or systems suffer from the disadvantage of, inter alia, and with particular reference to the knife or cutting assemblies, requiring a relatively high grade material. To wit, in order to provide these cutting assemblies with the required wear resistance and overall toughness, the materials and manufacturing processes used in making these knives are relatively particular and therefore, costly. Therefore, there is a need in the art to provide a new waste reducing knife assembly that overcomes the above-identified disadvantages.

Accordingly, a need exists for novel systems and methods which have, among other advantages, reduced manufacturing costs, as well as the ability to be easily replaceable, while providing acceptable wear resistance and toughness. Therefore, a knife assembly and method thereof that solves the aforementioned disadvantages and having the aforementioned advantages is desired.

SUMMARY OF THE PRESENT INVENTION

The aforementioned drawbacks and disadvantages of these former knife systems have been identified and a solution is set forth herein by the inventive knife assembly which includes, a drum assembly for a waste processing system which comprises a plurality of cutters disposed on a drum, wherein the cutters comprise a cutter body; a knife assembly which includes a first clamp, a second clamp; and a knife. Further, the knife is interposed, situated, removably affixed, or otherwise operably disposed between the first and second clamps, wherein at least one cutting surface extends beyond respective ends of the first and second clamps. The cutter body and knife assembly are then operably disposed on a drum for a waste processing system.

Further embodiment includes: a first clamp comprising a first notch which includes an abutment for positioning an end of the knife; a threaded fastening system for removably securing the knife between the first and second clamps; a knife comprising a second notch for positioning the knife in relation to the threaded fastening system; and a cutter body which comprises a pocket for retaining the knife between the first and second clamps.

In another aspect of the invention, a cutter assembly for a waste processing system is disclosed and comprises a plurality of cutters disposed on a drum wherein the cutters comprise a cutter body including a pocket, and a knife assembly including a first clamp and a knife comprising a cutting edge. The knife is interposed, situated, removably affixed, or otherwise adapted to be operably disposed between the first clamp and the pocket such that the cutting edge extends therebeyond.

A further embodiment comprises a second clamp whereby the knife is adapted to be operably disposed between the first and second clamp and the pocket such that the cutting edge extends therebeyond.

In yet another aspect of the invention a knife assembly for a waste processing system is disclosed which includes a cutter body. The knife assembly comprises a first clamp and a knife comprising a cutting edge, whereby the knife is adapted to be removably affixed between the first clamp and the cutter body of the waste processing system such that the cutting edge extends beyond the ends of the first clamp and the cutter body. The system may further comprise a second clamp, whereby the knife is adapted to be removably affixed between the first and second clamp, and the first and the second clamp are adapted to be removably affixed to the cutter body of the waste processing system such that the cutting edge extends therebeyond.

In still another aspect of the invention a drum assembly for a waste processing system comprises a drum which includes a plurality of cutters disposed on a drum and an outside surface. The cutters further comprise a knife assembly including a first clamp, a second clamp, and a knife, wherein the knife is disposed between the first and second clamps and have at least one cutting surface extending beyond the outside surface of the drum.

A further embodiment may include: a first clamp comprising a first notch having an abutment for positioning an end of the knife; a threaded fastening system for removably securing the knife between the first and second clamps; and a cutter body which further comprises a pocket for retaining the knife between the first and second clamps.

In yet still another aspect of the invention a cutter assembly for a drum of a waste processing system is disclosed and includes a drum comprising a base and an outer surface; a knife assembly including a first clamp, and a knife comprising a cutting edge. The knife is adapted to be operably disposed between the first clamp and the base such that the cutting edge extends beyond the out surface of the drum. Yet further, a second clamp may be included whereby the knife is adapted to be operably disposed between the first and second clamp, and the first and second clamp are adapted to be attached to the base such that the cutting edge extends therebeyond.

In yet another aspect of the invention a replaceable knife assembly for a waste processing system which includes a drum is disclosed, wherein the knife assembly comprises a first clamp and a knife comprising a cutting edge. The knife is adapted to be removably affixed between the first clamp and the drum of the waste processing system such that the cutting edge extends therebeyond. Further, disclosed is a second clamp, whereby the knife is adapted to be removably affixed between the first and second clamp, and the first and the second clamp are adapted to be removably affixed to the drum of the waste processing system such that the cutting edge extends therebeyond.

In still another aspect of the invention a method of replacing a knife for a waste processing machine comprises, in a waste processing machine including a cutting assembly which further includes a knife assembly comprising at least a first support and a first disposable knife, the steps of: providing a second disposable knife; removing the first support to access the first knife and removing the first knife; replacing the first knife with the second knife by disposing the second knife between the first support and the cutting system, and reaffixing the first support to the cutting system; and yet further, the first support may substantially cover and support the knife while exposing a cutting end of the knife, whereby the cutting end of the knife extends outwardly from the cutting system.

In yet another aspect of the invention a waste processing machine for reducing wood material is disclosed which includes: a frame comprising at least one pair of wheels; a primary power source operatively supported by the frame; an infeed assembly for receiving waste material to be reduced; a rotatable cutting assembly operatively supported by the frame and spaced from the infeed assembly, the cutting assembly comprising a cutting head or drum axially mounted on a shaft, the shaft operatively connected to the primary power source for rotation thereof; a feed system disposed between the infeed assembly and the cutting assembly to feed material to the cutting assembly; and a replaceable knife assembly wherein the knife assembly comprises a first clamp and a knife adapted to be removably affixed between the first clamp and the cutting head or drum. Further, disclosed is a second clamp, whereby the knife is adapted to be removably affixed between the first and second clamp.

Other objects, advantages, and features of the invention will become apparent upon consideration of the following detailed description and drawings. As such, the above brief descriptions set forth, rather broadly, the more important features of the present novel invention so that the detailed descriptions that follow may be better understood and so that the contributions to the art may be better appreciated. There are of course additional features that will be described hereinafter which will form the subject matter of the claims.

In this respect, before explaining the preferred embodiment of the disclosure in detail, it is to be understood that the disclosure is not limited in its application to the details of the construction and the arrangement set forth in the following description or illustrated in the drawings. To wit, the knife assembly of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the claims, unless so claimed.

As such, those skilled in the art will appreciate that the conception upon which this disclosure is based may readily be used as a basis for designing other structures, methods, and systems for carrying out the several purposes of the present invention. It is important therefore that the claims are regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any manner.

These and other objects, along with the various features and structures that characterize the invention, are pointed out with particularity in the claims annexed to and forming a part of this disclosure. For a better understanding of the knife assembly of the present disclosure, its advantages, and the specific traits attained by its use, reference should be made to the accompanying drawings and other descriptive matter in which there are illustrated and described the preferred embodiments of the invention.

As such, while embodiments of the knife assembly are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 12 pages of drawings are disclosed with an informative, but not limiting, intention.

DETAILED DESCRIPTION OF THE PREFERRED EMBODIMENT

The best mode for carrying out the invention is presented in terms of the preferred embodiment, wherein similar referenced characters designate corresponding features throughout the several figures of the drawings.

Figure 2:
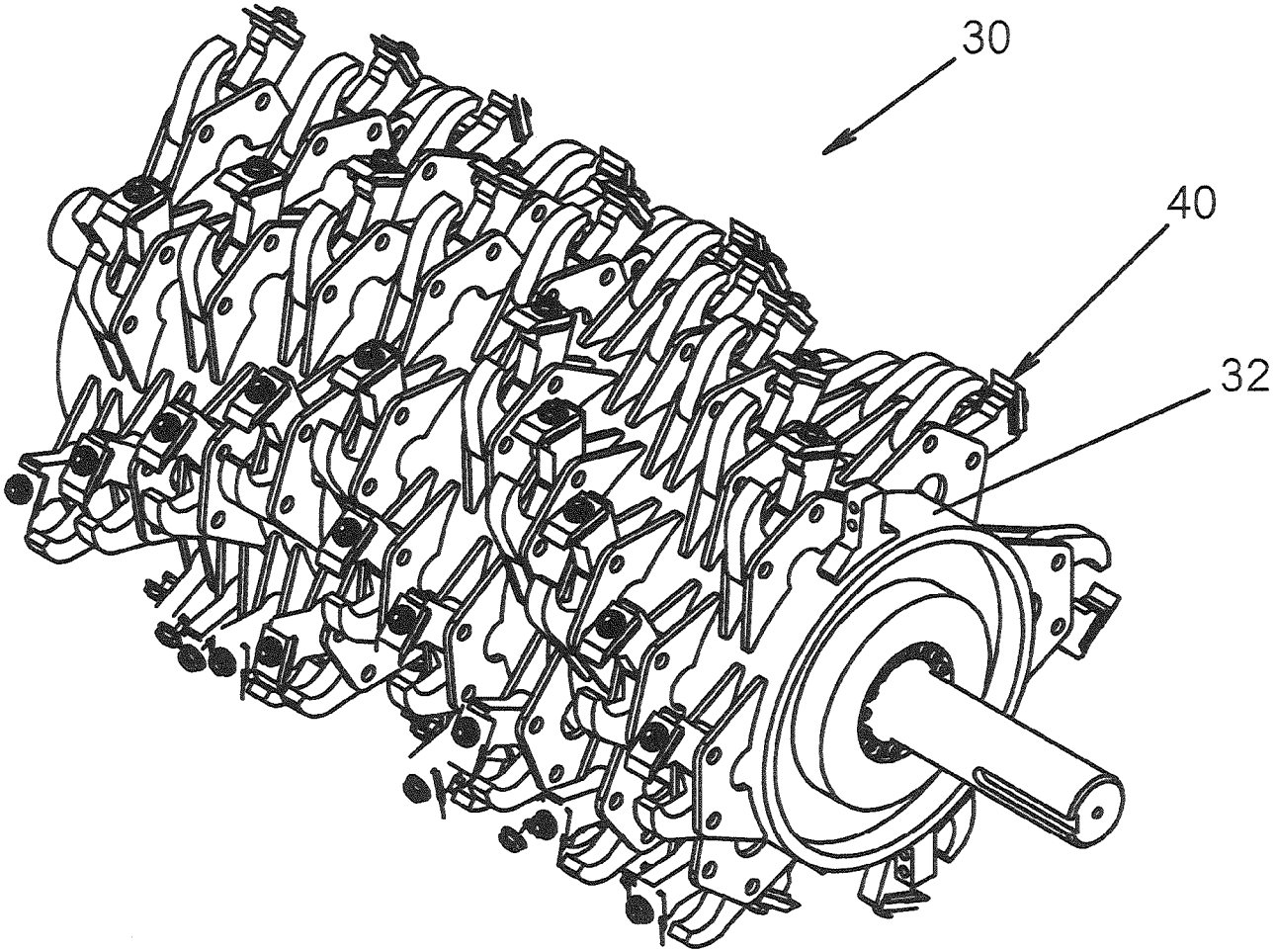
FIG. 2 is a perspective view of a drum assembly according to one embodiment of the present invention.

For purposes of description herein, the terms "upper", "lower", "right", "left", "rear", "front", "vertical", "horizontal", and derivatives thereof, shall relate to the invention as oriented in FIG. 2. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Where appropriate, the various similar features have been further differentiated by an alphanumeric designation, wherein the corresponding alphabetic designator has been changed. Further, the dimensions illustrated in the drawings (if provided) are included for purposes of example only and are not intended to limit the scope of the present invention. Additionally, particular details in the drawings which are illustrated in hidden or dashed lines are to be considered as forming no part of the present invention.

As used herein, the terms wood and wood products are meant to be used and defined in their broad, general, and ordinary sense, and the terminology is meant to include trees, brush, trunks, stems, branches, leaves, or the like, or anything else that could otherwise be recycled, reduced, or otherwise processed; and further includes non-naturally occurring or manufactured wood products such as lumber, pallets, or other manufactured products that could otherwise be recycled, reduced, or otherwise processed, as is generally known within the art.

As used herein, the term waste processing system is meant to be used and defined in its general and ordinary sense. To wit, systems that recycle, reduce, or otherwise process wood products. Included therein are machines that chip, cut, grind, or otherwise reduce wood waste products and include, generally, chippers and/or shredders. Of course, this is not meant to be limiting in any manner and these systems may take on numerous configurations, and may be used for numerous purposes as is generally known within the art.

Figure 1:
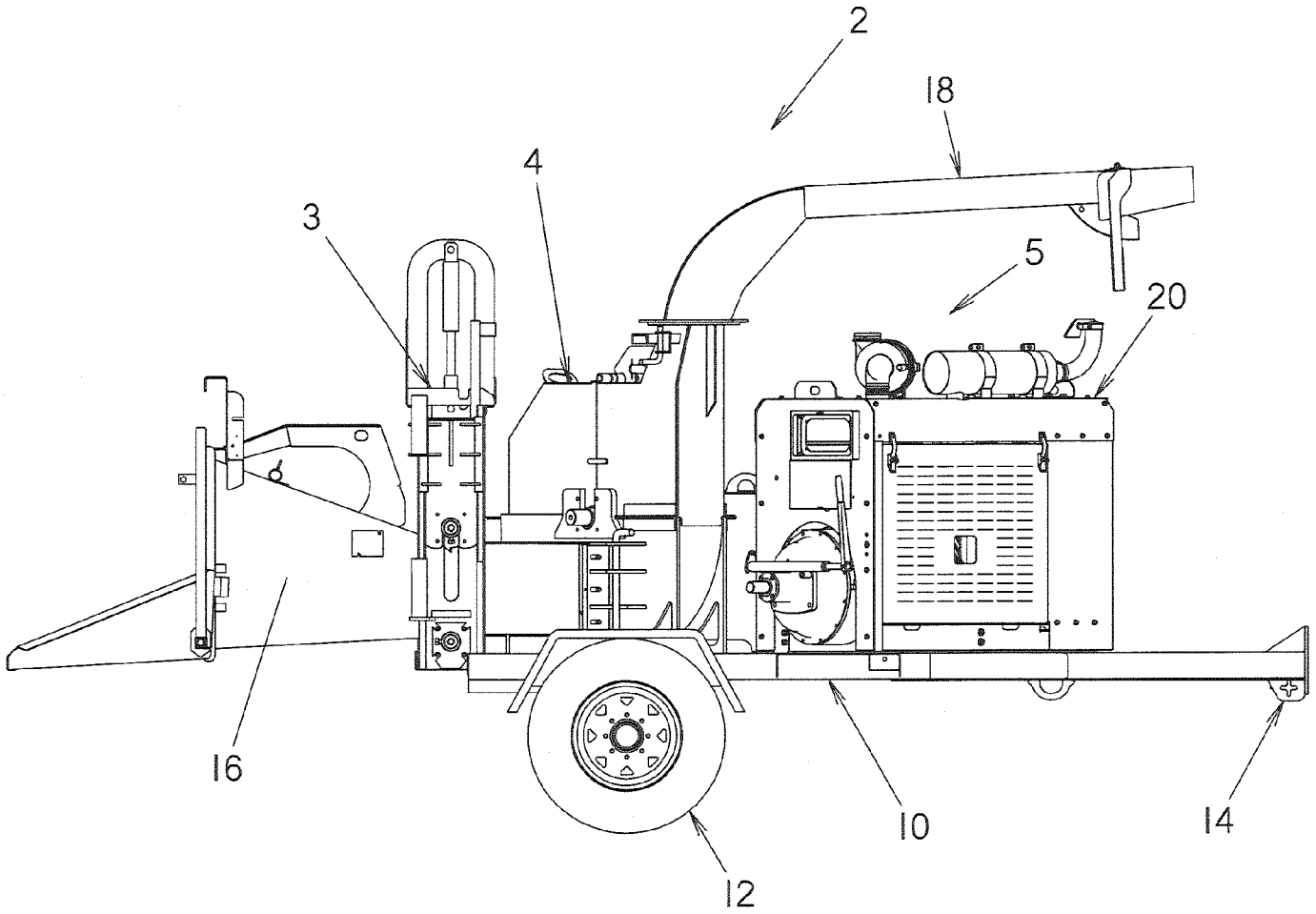
FIG. 1 PRIOR ART
FIG. 1 is a side view of a prior art waste processing system.

Generally, waste processing machines (e.g., wood chippers) are commonly known and regularly utilized to reduce branches, trees, and other bulk wood products into smaller wood chips. It should be understood that the knife assembly 50 disclosed herein may be utilized on any suitable waste reducing machinery such as the trailerable wood chipper as seen in FIG. 1, or any other machinery used to chip, grind, cut, or otherwise reduce bulk products. As depicted in FIG. 1, an exemplary prior art system is disclosed and includes the primary components of a feed system 3, cutting or reducing system 4, and a power source 5. As is generally known in the art these systems may further comprise a frame 10, supported by a pair of wheels 12, and a conventional trailer hitch 14 to allow the system to be towed by a vehicle. Supported on the chipper frame 10 is an infeed chute 16, and a discharge chute 18. As is generally the case, an internal combustion engine 20 is mounted on the frame 10 to provide rotational energy to both the feed system 3 and the cutting system 4.

The internal combustion engine is typically operated such that the cutting system 4 rotates at a high velocity while the feed system 3 rotates relatively slowly. In operation, trees, brush, and other bulk wood products are fed into the infeed chute 16 and captured between, in this particular example, the opposed, rotating feed wheels (not shown) until the bulk (e.g., wood) products encounter the cutting system 4 (e.g., a rotary or drum cutting system). The cutting system (not shown) reduces the bulk wood products into chips which are then expelled from the mechanism via the discharge chute 18.

Figure 1A:
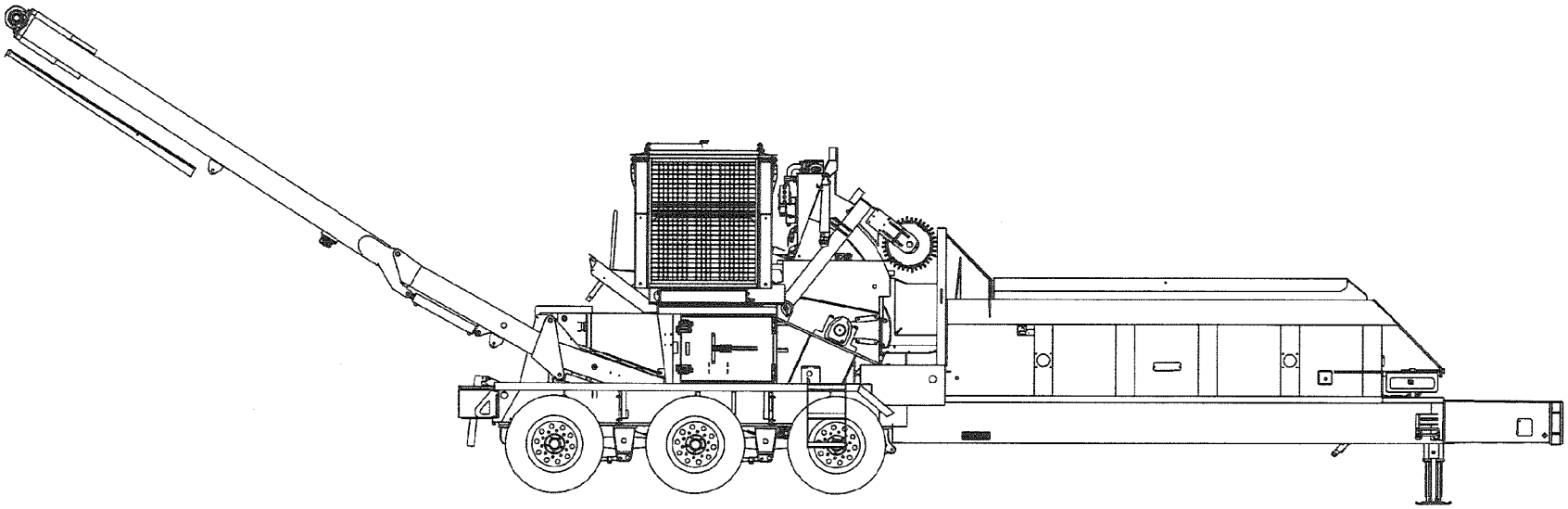
FIG. 1A is a side view of an exemplary waste processing system.

As described herein, it should be understood that this disclosure describes the structure and operation of a knife system with respect to a drum cutting system. However, the disclosed system can be utilized on any cutting system for a waste processing machine including drum, wheel, or other cutting systems having replaceable knives. Such a system is illustrated in FIG. 1A which illustrates a waste processing machine comprising a drum style cutting system.

While not meant to be limiting in any manner, it is envisioned that this system may offer the following advantages: The improved knife assembly is designed to utilize lower cost materials over prior art cutting systems, as well as is configured to be easily replaceable. For example, in one embodiment, the system comprises a drum assembly 30 including a knife 56 which is disposed between a first clamp 52 and a second clamp 54. As such, the knife 56 may utilize a material having a lower cost than is currently utilized while exhibiting similar strength. For example, while the knife 56 is disposed and supported by the first and second clamps, 52 and 54 respectively, the improved knife can be manufactured from less expensive materials and utilize a thinner profile, with performance characteristics akin to the more expensive, existing knives. As such, the overall costs associated with these waste processing systems are reduced by the inventive knife assembly. Additionally, as these waste processing knives are a component subject to wear and require replacement, the inventive knife yields a system that is easier to replace than existing systems. As such, while existing cutting systems utilize relatively high grade materials and a thickness appropriate for the required rigidity, the novel system disclosed herein offers the advantages of, in a non limiting manner, allowing for the use of less expensive material, lower material costs, and ease of replacement.

Accordingly, a need exists for improved knife systems that have, among other advantages, the ability to reduce costs and increase ease of use. Therefore, a knife assembly that solves the aforementioned disadvantages and having the aforementioned advantages is disclosed herein.

The disadvantages and drawbacks of the prior art are overcome through the knife assembly of the present invention, wherein one preferred embodiment is disclosed in FIGS. 2-10.

Figure 2A:
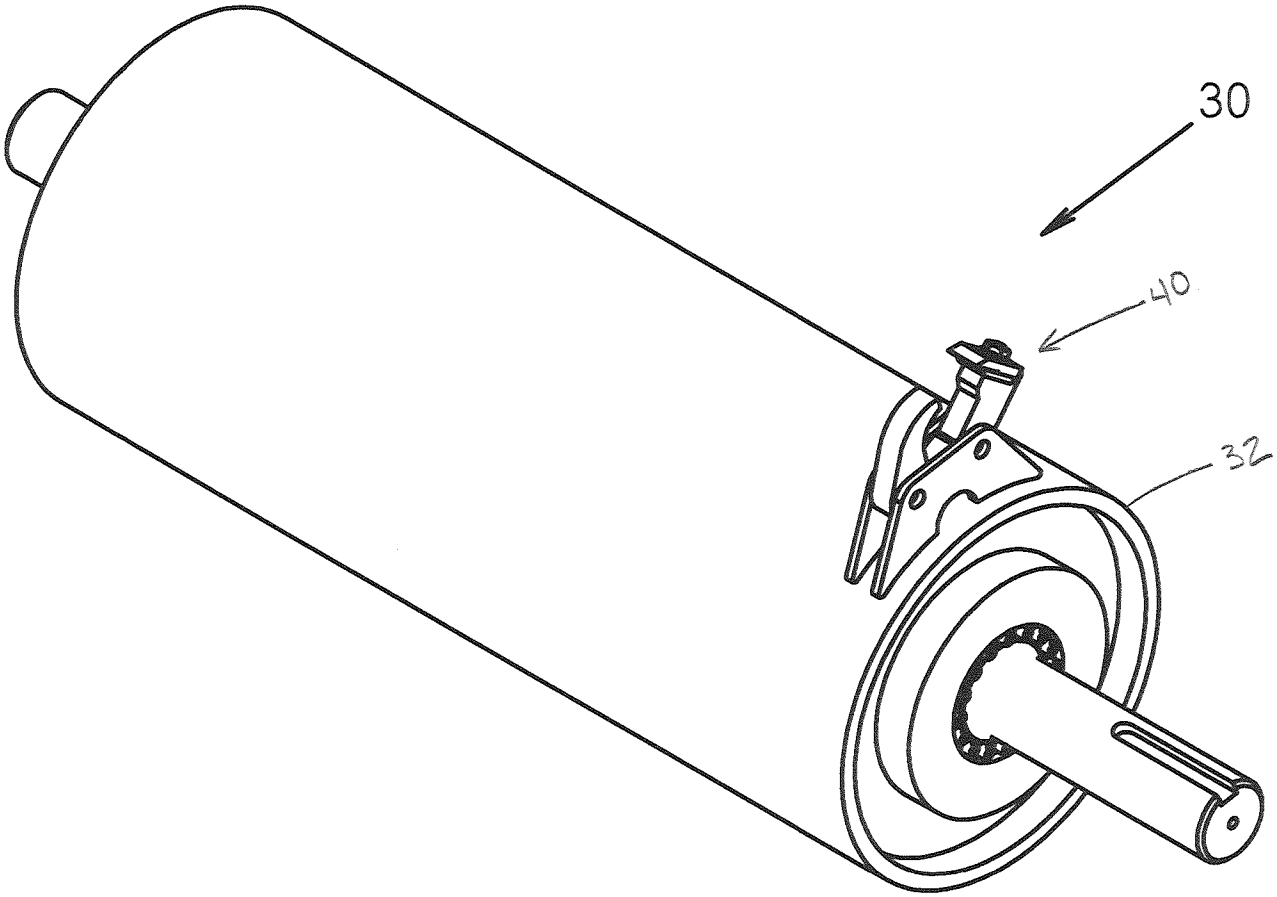
FIG. 2A is a perspective view of the drum assembly of FIG. 2 illustrating a single cutter for illustrative simplicity.

Referring now to FIG. 2, there is shown an embodiment of the knife assembly 50 wherein is shown a drum assembly 30 for a waste processing system and includes a plurality of cutters 40 disposed on a drum 32. FIG. 2A illustrates such a drum 32 including only a single cutter 40, and is for illustrative purposes only.

Figure 3:
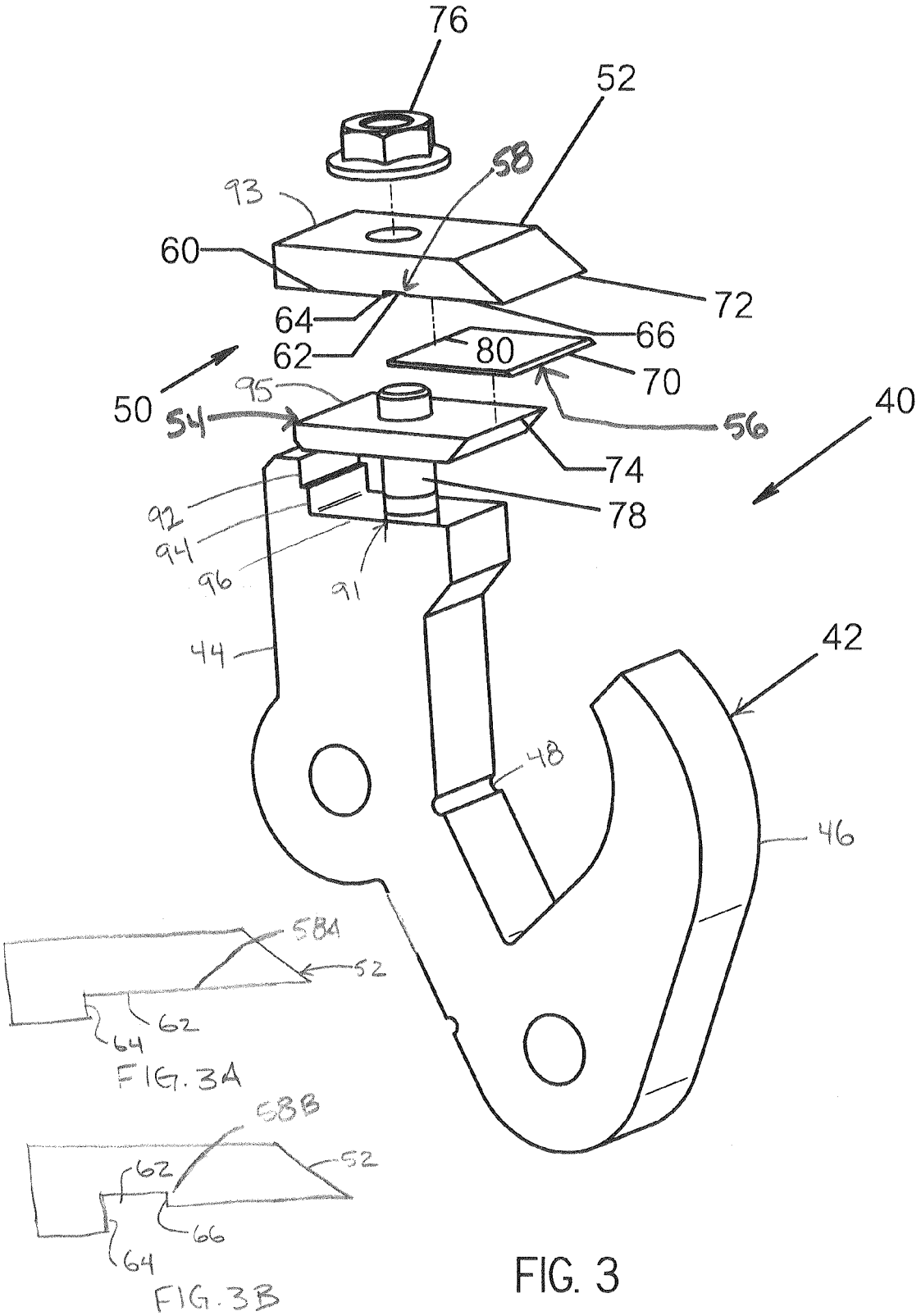
FIG. 3 is an exploded perspective view of an embodiment of a cutter of the present invention.

As is further illustrated in FIG. 3, cutters 40 further include a cutter body 42 comprising a first arm 44, a second arm 46, and may also comprise a stress notch 48. Cutter bodies are described in U.S. Pat. No. 5,863,003, filed Apr. 24, 1996; U.S. Pat. No. 6,047,912, filed May 1, 1998; U.S. Pat. No. 6,299,082, filed May 1, 1998; U.S. Pat. No. 6,059,210, filed Jan. 20, 1999; U.S. Pat. No. 6,517,020, filed Sep. 8, 2000; and 6,845,931, filed Oct. 3, 2001, all to Smith and all of which are incorporated herein by reference in their entirety.

Also shown is a knife assembly 50 which includes a first, and in this configuration an upper clamp 52, a second, and in this configuration a lower clamp 54, and a knife 56 operably disposed therebetween so as to have a cutting end or edge 70 extending from ends 72 and 74 of first and second clamps, respectively. Further to this embodiment is shown a (first) notch, cutout or other positioning feature 58 disposed on a (first) surface 60 of support 52. FIG. 3A shows a first step 62 having an abutment 64, while FIG. 3B illustrates a multi-stepped notch including a first step 62 having an abutment 64 and a second step 66.

Figure 4:
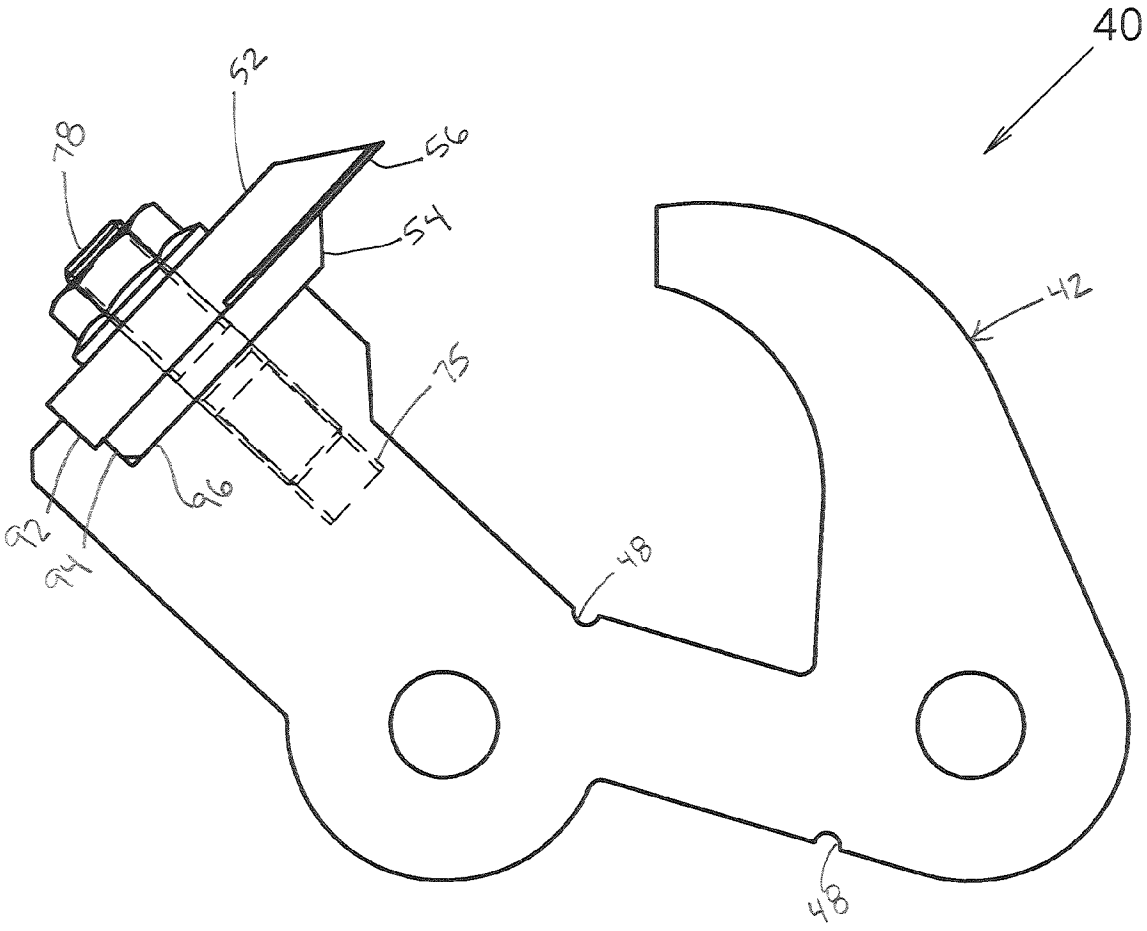
FIG. 4 is a non-exploded side view of the cutter of FIG. 3.

In this embodiment, knife 56 is interposed, situated between, and removably affixed between the first and second clamps such that at least one cutting surface 70 extends beyond respective ends, 72 and 74, of the first and second supports or clamps 52 and 54 when installed therebetween and mounted to cutter body 42 as shown in FIG. 4. For example only, this connection may be through a nut 76 and a threaded shaft 78 received in a recess or hole 75 in body 42, thereby securely positioning the assembly 50 such that an end 80, opposite to cutting surface end 70, resides adjacent abutment 64. As illustrated, cutter body 42 may comprise a notch or recess 91 having a base 96 and abutments 92 and 94, whereby ends 93 and 95 of first and second clamps 52 and 54, respectively, reside as illustrated in FIG. 4. One or more cutters 40 may then be disposed on drum 32 to arrive at the configuration depicted in FIG. 2 for use on or within a waste processing system, such as that depicted in FIG. 1.

Figure 5:
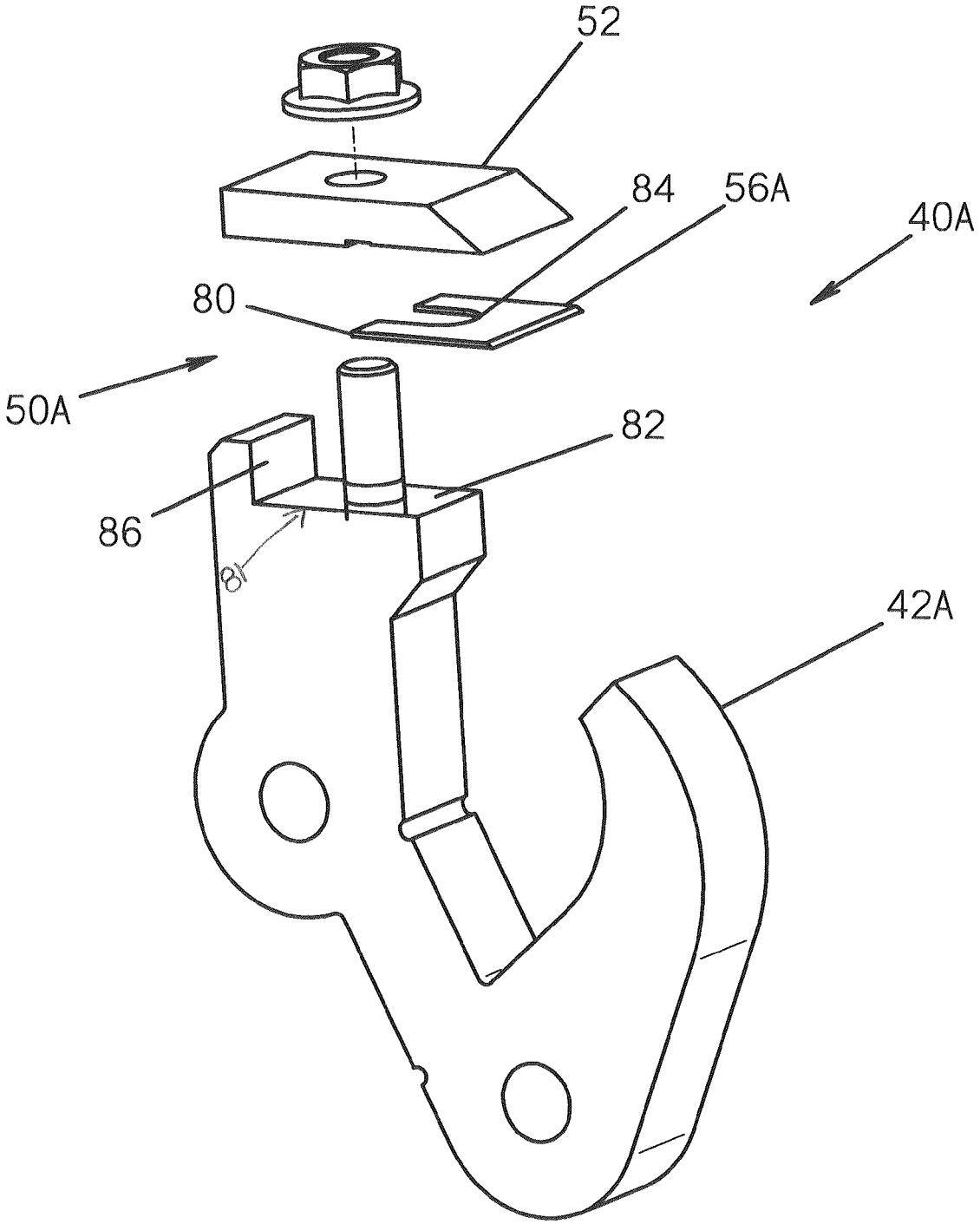
FIG. 5 is a an exploded perspective view of an alternate embodiment of a cutter of the present invention.
Figure 6:
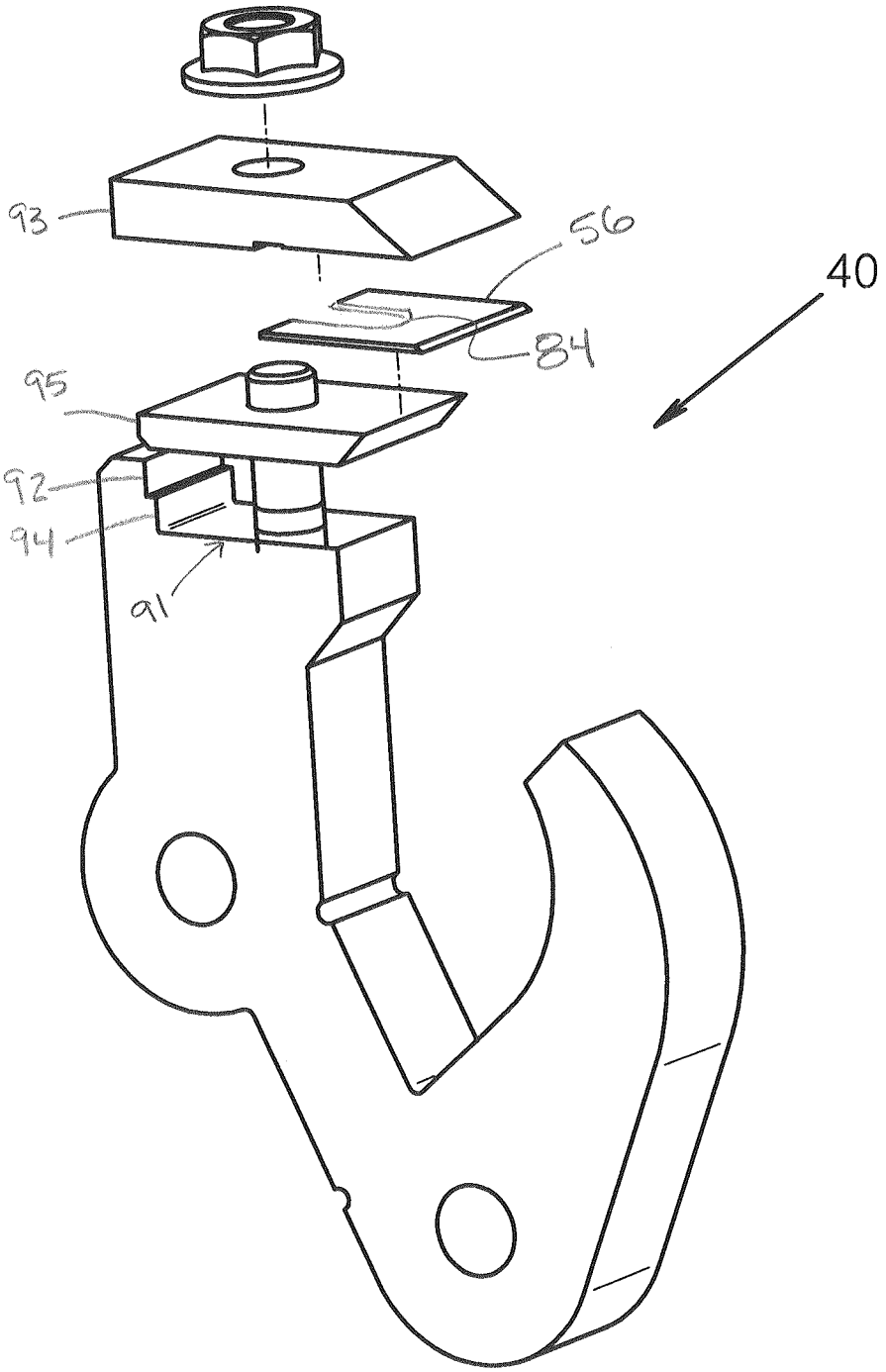
FIG. 6 is a an exploded perspective view of another alternate embodiment of a cutter of the present invention.

An alternate embodiment 40A is depicted in FIG. 5 and includes a knife assembly 50A comprising a first support 52 and a knife 56A. In this embodiment, the second support 54 is not utilized and instead the knife 56A is situated in a recess, notch, or pocket 81 and between the first support 52 and a base 82 of cutter body 42A. Also illustrated on knife 56A is a positioning feature 84. In the illustrated example, a (second) notch is utilized. However, other features such as a notch, hole, or surround may be used. Additionally, knife end 80 may be disposed adjacent abutment 86. FIG. 6 illustrates yet another embodiment wherein pocket 91 is used with positioning feature 84.

Figure 7:
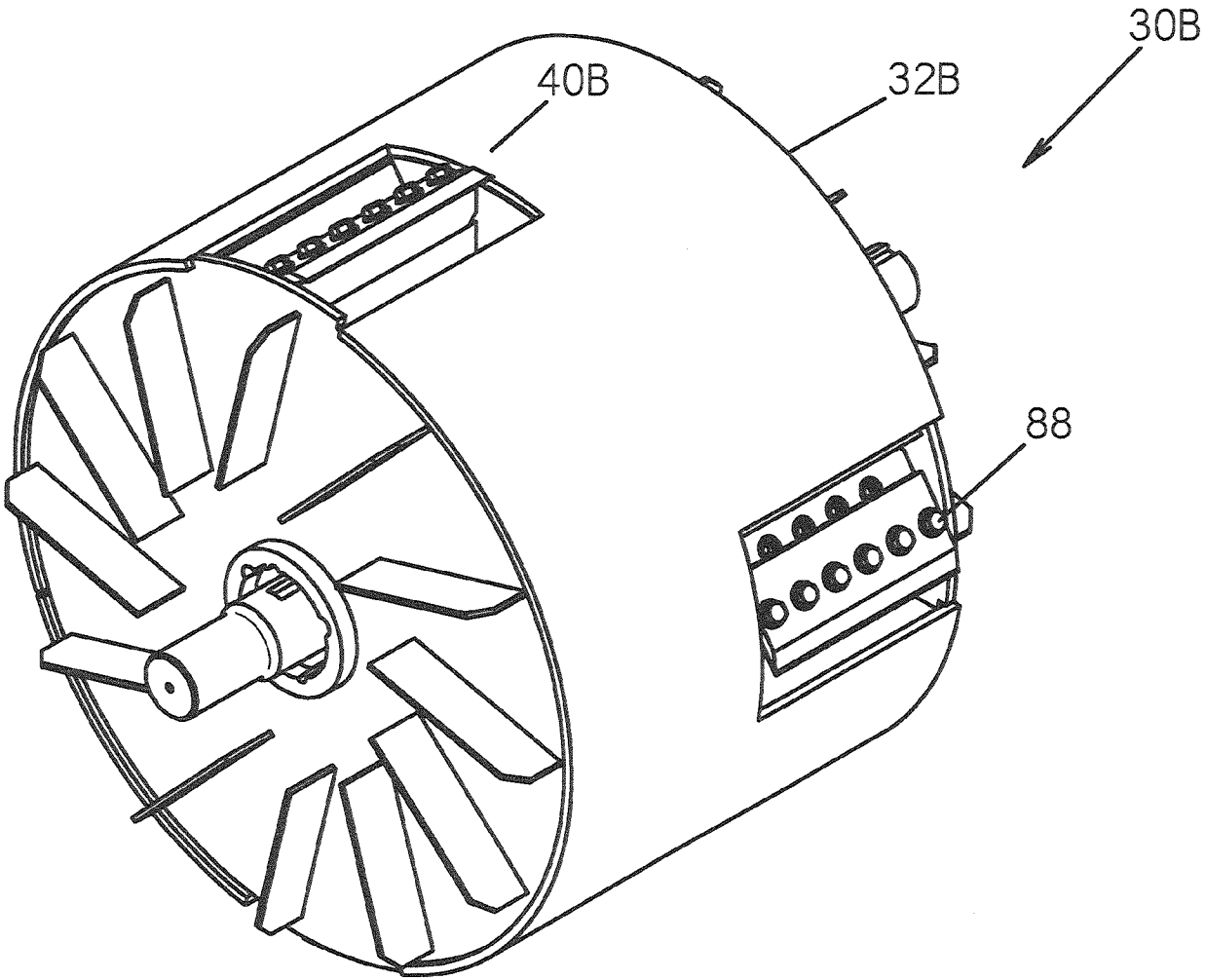
FIG. 7 is a perspective view of a drum assembly according to one embodiment of the present invention.
Figure 8:
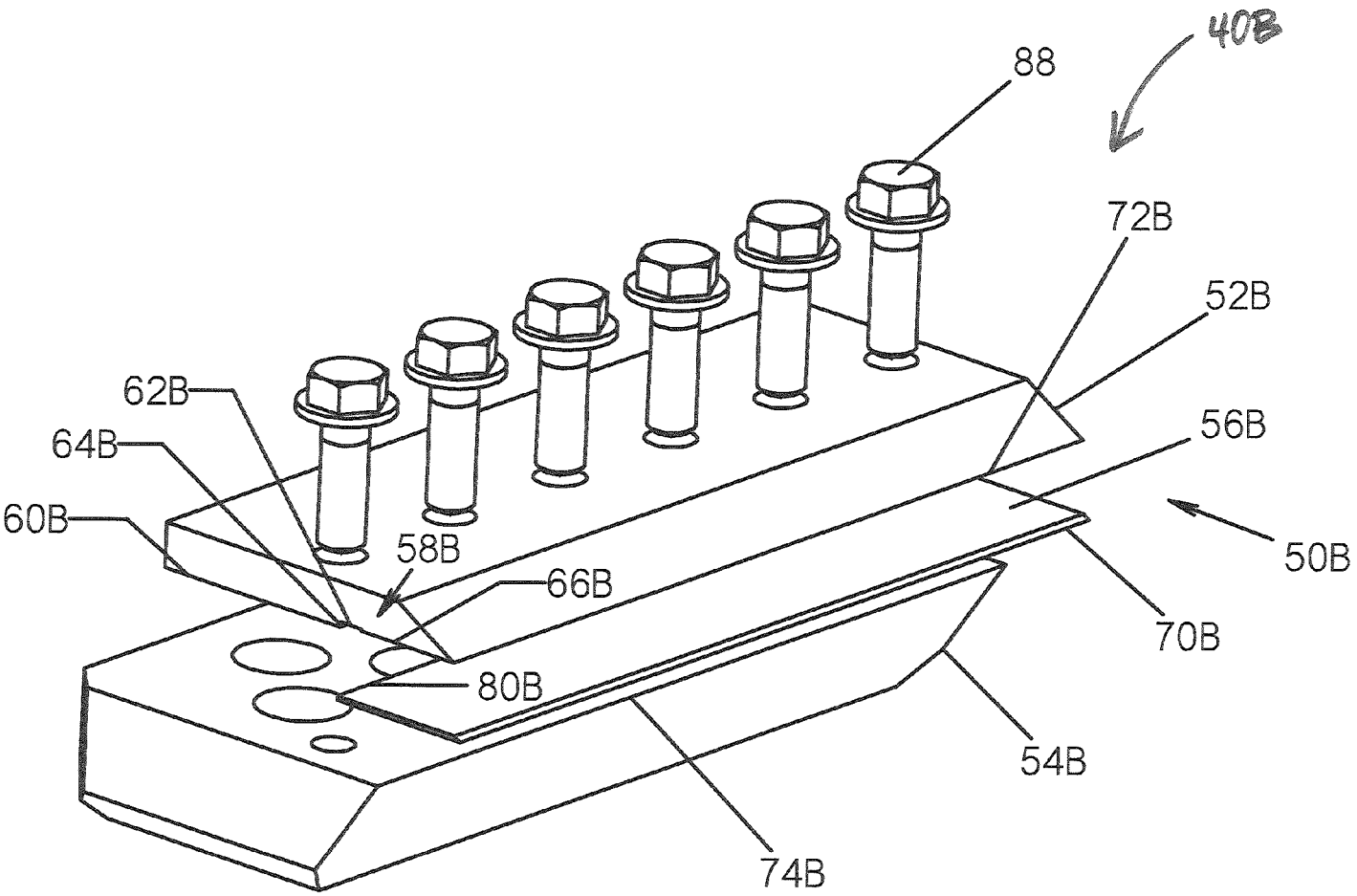
FIG. 8 is an exploded perspective view of an embodiment of a cutter of the present invention.

An alternate embodiment of the drum assembly 30B is disclosed in FIG. 7 and includes a plurality of cutters 40B disposed on a drum 32B. As is further illustrated in FIG. 8, cutters 40B further comprise a knife assembly 50B including a first, and in this configuration an upper clamp 52B, a second, and in this configuration a lower clamp 54B, and a knife 56B. This embodiment may also include, as described above, a notch, cutout or other positioning feature 58B disposed on a surface 60B of support or clamp 52B. This embodiment may also include the aforementioned multi-stepped notch including a first step 62B having an abutment 64B and a second step 66B.

In this embodiment, knife 56B is interposed, situated between, and removably affixed between the first and second clamps such that at least one cutting surface 70B extends beyond respective ends, 72B and 74B, of the first and second supports or clamps 52B and 54B when installed therebetween and mounted to drum 32B as shown in FIG. 7. For example only, this connection may be through one or more bolts 88, thereby securely positioning the assembly 40B such that an end 80B, opposite to cutting surface end 70B, resides adjacent abutment 64B. One or more cutters 40B may then be disposed on drum 32B to arrive at the configuration depicted in FIG. 7 for use on or within a waste processing system, such as that depicted in FIGS. 1 and 1A.

Also illustrated is a first support 52B which substantially covers and supports the knife while exposing the cutting end 70B of the knife. Similarly, illustrated is a second support 54B which substantially covers and supports the knife while exposing the cutting end 70B of the knife. The substantial support may comprise a first and second clamping surface which extends the entire length of the knife as illustrated, or some fractional coverage of the surface of the knife, for example only from about 50% to 100% coverage, and while a single-piece first and second clamping surface which extends the entire length of the knife is illustrated, multiple first and/or second clamping surface which extend less than the entire length may also be used.

Figure 9:
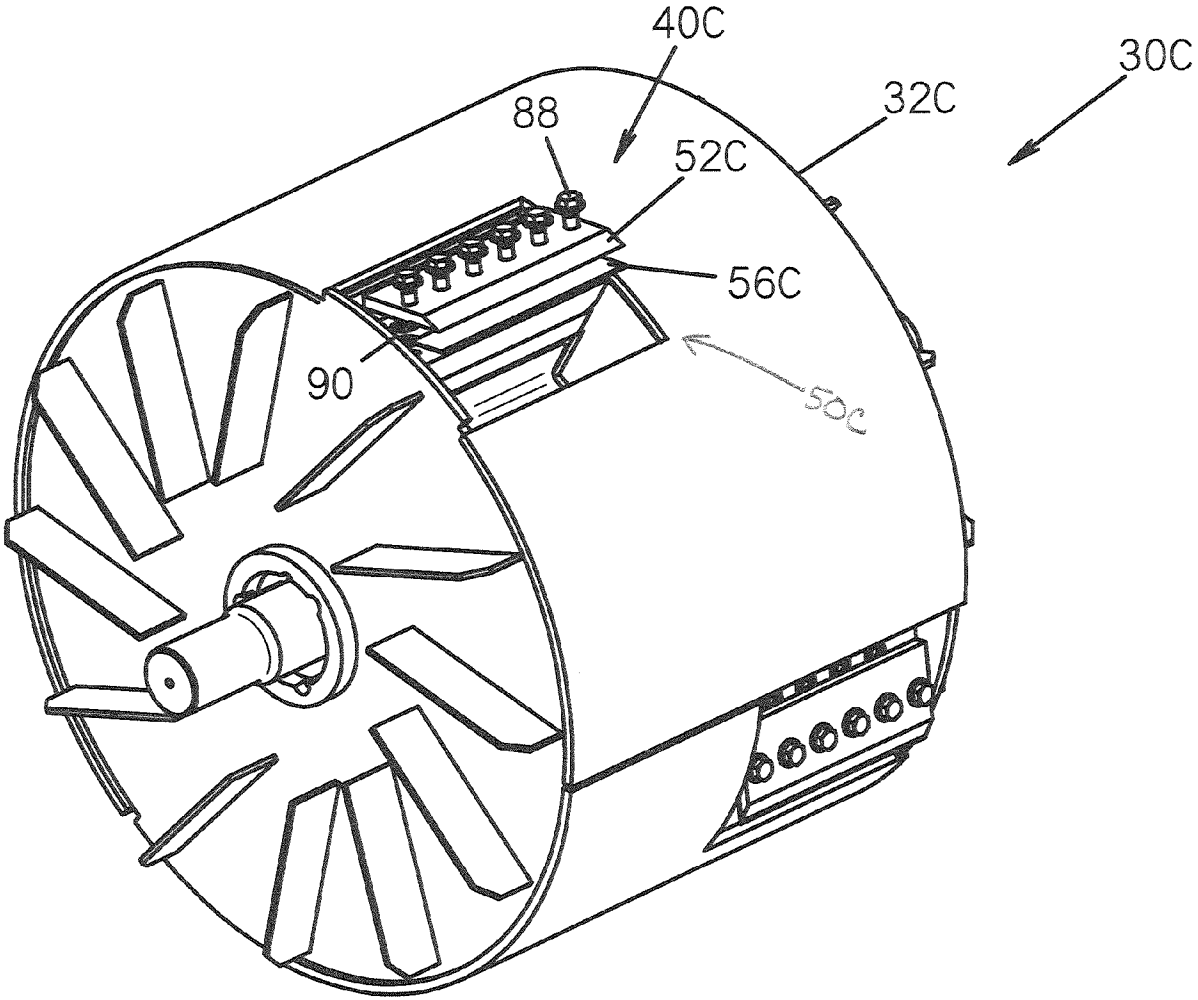
FIG. 9 is a perspective view of a drum assembly according to another embodiment of the present invention.
Figure 10:
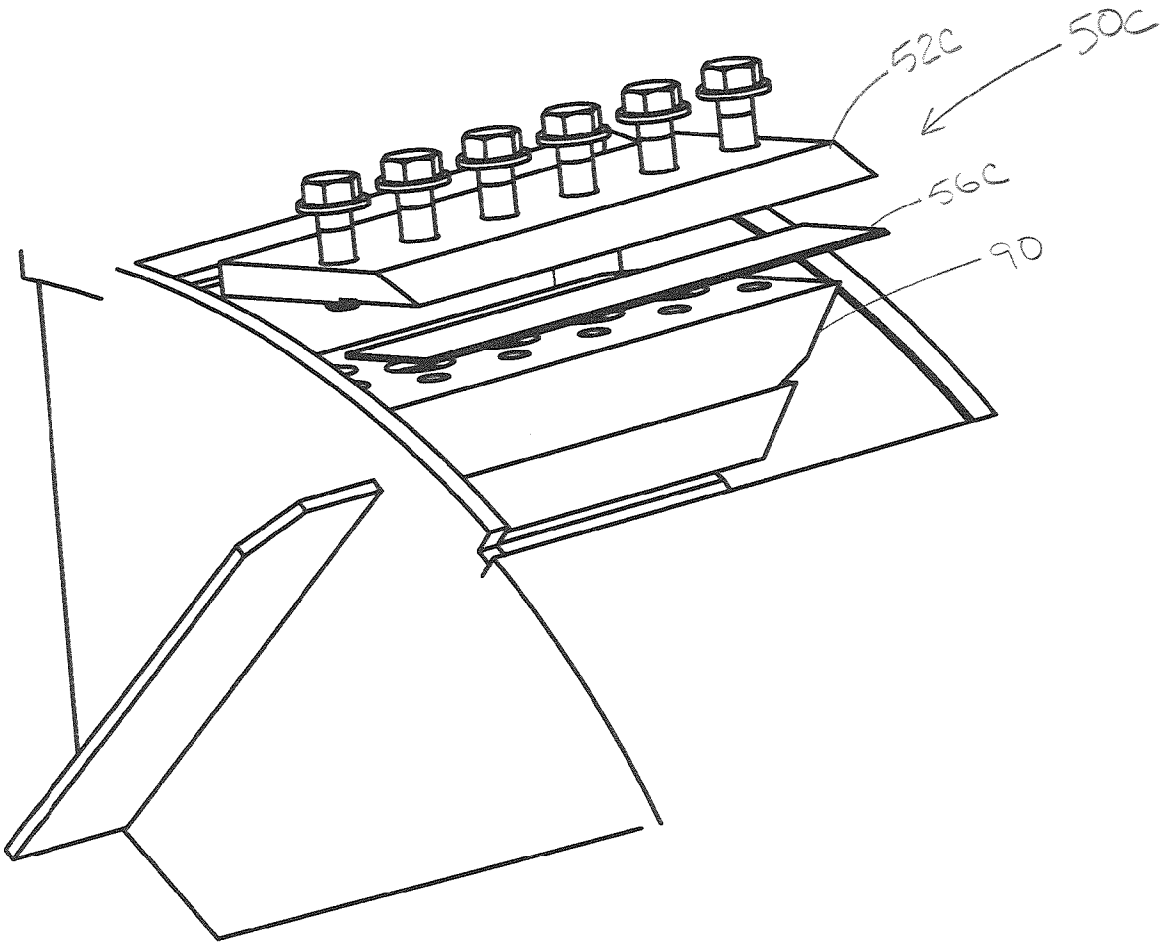
FIG. 10 is a partial exploded perspective view of the cutter of FIG. 9.

Yet another embodiment 40C is depicted in FIG. 9 and includes a knife assembly 50C comprising a first support 52C and a knife 56C. In this embodiment, the second support 54B is not utilized and instead the knife 56C is situated between the first support 52C and a base 90 of drum 32C.

The specific configurations and features of the knife may vary according to specific requirements. In one preferred embodiment, knife 56 is generally rectangular in shape and is fabricated in a one-piece configuration from 1/16th inch steel (0.0625 inches). Further, and while not meant to be limiting, the knife may be fabricated from a less expensive or lower grade material than is typically utilized for these cutting devices, as opposed to ⅝ (0.625 inches) or ½ (0.500 inch) steel fabricated from a costlier and higher grade material (e.g., higher grade cutting tool material such as chipping knife material). As an example, one application utilizes a material that is generally used for saw blade applications. Of course, utilizing higher grade materials is also an option.

Further, the shape of knife 56 may vary according to particular requirements. Additionally, in one preferred embodiment, the first and second supports are at least as wide as the knife and when assembled reveal or expose only the cutting edge 70 of the knife, thereby fully supporting the knife during operation. Of course, this may be varied according the particular requirements of the knife as long as the knife is supported (e.g., does not allow for unacceptable deformation or movement of the knife) during use. It is also to be understood that various modifications may be made to the knife without departing from the inventive concept and that the description contained herein is merely a preferred embodiment and hence, not meant to be limiting unless stated otherwise.

The knife 56 may be retained to a material reducing (e.g., drum 32) system as herein described. Upon use then, the knife will become worn and require either sharpening or replacement. The novel system described herein can be easily removed by either loosening or removing the first clamp, and possibly the second clamp if so used and if so required, removing the knife 56, reinstalling the new or repaired knife, and then reassembling for further use.

Advantageously, the knife assembly of the present invention has among other advantages, the ability to reduce the overall costs associated with a waste processing system and increase the ease of use, repair, and replacement.

The solutions offered by the invention disclosed herein have thus been attained in an economical, practical, and facile manner. To wit, a novel knife assembly which is cost effective; easily installed, used, and repaired; and strong is disclosed herein. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to be appreciated that various changes, rearrangements, and modifications may be made therein, without departing from the scope of the invention as defined by the claims.

The invention claimed is:

1. A drum assembly for a waste processing system comprising:

a plurality of cutters, the cutters further comprising:

a removable cutter body;

a knife assembly including a first clamp a second clamp, and a knife;

the knife operably disposed between the first and second clamps and having at least one cutting surface extending beyond respective ends of the first and second clamps;

a threaded fastening system for removably securing the knife between the first and second clamps;

wherein the first clamp comprises a first notch which includes an abutment for positioning an end of the knife and the knife comprises a second notch for positioning the knife in relation to the threaded fastening system, whereby the second notch abuts the threaded fastening system;

the cutter body and knife assembly operably disposed on a drum for a waste processing system.

* * * * *